US005599176A

United States Patent [19]

Reinersmann

[11] Patent Number: 5,599,176

[45] Date of Patent: Feb. 4, 1997

[54] THREADED-ROTOR COMPRESSOR

[75] Inventor: Hans-Hermann Reinersmann, Essen, Germany

[73] Assignee: MAN Gutehoffnungshütte Aktiengesellschaft, Oberhausen, Germany

[21] Appl. No.: 383,247

[22] Filed: Feb. 3, 1995

[30] Foreign Application Priority Data

| | | | |
|---|---|---|---|
| Feb. 5, 1994 | [DE] | Germany | 44 03 649.3 |
| Feb. 5, 1994 | [DE] | Germany | 44 03 648.5 |
| Feb. 5, 1994 | [DE] | Germany | 44 03 647.7 |

[51] Int. Cl.[6] ..... F04B 17/00

[52] U.S. Cl. ..... 417/420; 417/410.4

[58] Field of Search ..... 418/201.1, 69; 417/420, 410.4

[56] References Cited

U.S. PATENT DOCUMENTS

| | | | |
|---|---|---|---|
| 1,834,976 | 12/1931 | Schmidt | 418/94 |
| 3,417,915 | 12/1988 | Granberg | 418/94 |
| 4,293,290 | 10/1981 | Swanson | 418/206.7 |
| 4,490,102 | 12/1984 | Carre et al. | 418/201.1 |
| 4,674,960 | 6/1987 | Rando et al. | 417/420 |
| 4,886,437 | 12/1989 | Schubert | 418/206.7 |
| 5,295,798 | 3/1994 | Maruyama et al. | 418/201.1 |
| 5,374,173 | 12/1994 | Maruyama et al. | 418/201.1 |
| 5,449,278 | 9/1995 | Maruyama et al. | 418/201.1 |

FOREIGN PATENT DOCUMENTS

| | | | |
|---|---|---|---|
| 002016247 | 7/1994 | U.S.S.R. | 418/201.1 |

*Primary Examiner*—Timothy Thorpe
*Assistant Examiner*—Peter G. Korytnyk
*Attorney, Agent, or Firm*—Max Fogiel

[57] ABSTRACT

A rotary compressor with enmeshment between a helically geared male rotor and a helically geared female rotor. The bearing housings on the drive side (3) and the pressure side (15) have spigots (14) which protrude into the bores inside of the rotors (**12, 12*a*). The rotors (12, 12*a*) are mounted on the drive side in plain bearings (6, 22) as well as in radial bearings (9, 21) and are anchored with securing elements by means of shaft nuts (10, 19). On the mounting on the pressure side (15) radial bearings (16, 17) are used to mount the rotors (12, 12a). A torsion shaft (4) for the clutch half of the compressor drive (1) is guided through a bore on the drive side in the bearing housing (3) and in one of the four spigots (14). The torsion shaft (4), furthermore, could be coupled with the rotor (12) at the pressure side of the bearing housing (15**).

12 Claims, 4 Drawing Sheets

THREADED-ROTOR COMPRESSOR

BACKGROUND OF THE INVENTION

The invention concerns a rotary compressor with enmeshment between a helically geared male rotor and a helically geared female rotor.

The development of rotary screw compressors, i.e. twin-shaft rotary piston machines with distinct helical gear section and diagonal flow through its working space go back to the end of the last century. The basic patent originates from Lysholm, who recognised that an internal compression can be achieved by using helical gearing.

Accordingly, the rotary screw compressor transports the to-be-conveyed medium as a displacement machine with positive conveying not only from the suction side to the pressure side but also compressing it in this manner by reducing the gaps between the teeth. When the armatures or rotors rotate in the housing they disengage at the leading edge on the suction side, so that a cross-section and a volume will be produced for the purpose of suction. During further rotation the rotors become engaged again on their leading edges. The cross-section of the working space which moves along in the axial direction is reduced up to the leading edge on the compression side of the housing, where the compressed medium is pushed out.

Rotary screw compressors can be driven directly by a motor or via a built-in transmission.

Compressors with a high compression ratio (final pressure/suction pressure) over 4.0 are provided with an oil injection in the working space to limit the compression temperature at a maximum of 100° C. In this case, in contrast to compressors without oil injection, no differential transmission is necessary to protect the rotors from contacting each other.

In the case of rotary screw compressors the gap between the end faces of the rotors and the housing should be kept as small as possible to prevent leakage of the compressed medium. The tight sealing gaps necessary for this purpose are achieved by an accurate adjustment of the rotors' position relative to the housing while considering the to-be-expected operating conditions. At the same time, for safety reasons, a somewhat larger gap is chosen than the one required theoretically. However, this safety gap difference increases the extent of the leakage and reduces the efficiency of the compression.

By mounting a gap seal between the rotor spigots and the housing, i.e. directly connected to the working space of the rotors, the amount of leakage can be further reduced, however, this measure has the disadvantage that the distances between mounting have to be increased.

For the purpose of keeping the leakage of environmentally harmful media on the compressor's driven side at a minimum, sophisticated sealing constructions are used.

The rotors of the known rotary screw compressor have spigots provided at both ends, which are mounted in axial and radial bearings.

The strong deflection of the rotors and the simultaneous occurrence of high torsional and bending stresses on the driven rotor spigots is a disadvantage in this construction. To provide the rotors with an as high as possible rigidity and/or to enable to transfer the required torques, the spigots are made as large as possible. Consequently, the bearing diameter and the mounting distance has also to be chosen large.

SUMMARY OF THE INVENTION

Therefore the object of the invention is to reduce the load on the driven spigot for a rotary screw compressor and to provide the rotors with a higher rigidity overall, to reduce the sealing gap to a minimum between the end faces of the rotors and parts of the housing, to increase the efficiency by this and to construct a drive in such a manner that the sealing of the compressor will be improved.

According to the invention the rotary screw compressor has internally situated rotor mountings. The journal spigots, called spigots in the following, for the main and auxiliary rotors are parts of the bearing housings on the suction side and the pressure side, respectively. Consequently they are made of the same material, e.g. steel casting. The spigots engage the bores in the rotors, which have plain or antifriction bearings for mounting the spigots.

A particularly economical advantage of this bearing design is that the rotary compressor constructed in this manner is extremely short compared with a compressor according to the state-of-the-art.

For the mounting axial and radial bearing on the suction side and radial bearings on the pressure side or radial bearing on the suction side and axial and radial bearings on the pressure side may be used alternatively.

The drive of the rotary screw compressor may be provided optionally on one of the rotors on the suction or pressure side.

According to the invention for the drive a torsion shaft is provided, which is guided through a bore in the bearing housing on the suction or pressure side and in one of the four spigots. The drive of the compressor is carried out via a clutch on the external end of the torsion shaft.

The use of the sealing discs according to the invention can be carried out both for rotary screw compressors having external mountings for the rotors and for machines according to the invention, the rotors of which are mounted on housing spigots provided within the rotors.

During the assembly of the compressor the distance between the end faces of the rotor and the housing is set to zero. As a consequence of the longitudinal deformation of the housing and of the rotors due to heat expansion during operation, the rotors will cause the wear of the sealing discs inserted prior to an extent necessary for a contact-free running between the housing and the rotor. This gap, as small as possible, will adjust itself always when the compressor is used under the same load.

As material for the sealing discs a PTFE (polytetrafluoroethylene)-mica mixture is suggested. Sealing discs made from this extremely durable plastics-mineral mixture, known as Fluorsint, have already proved themselves. The suggestion of the invention extends, of course, to other materials or mixtures of materials having the same or similar properties.

The sealing discs are screwed or glued on to the housing parts on the suction or pressure sides. They can also be inserted in a form-locking manner.

When the sealing discs described are used it could be of advantage to provide the axial bearing of the rotors on the suction side of the compressor for the purpose of achieving tighter face gaps on the pressure side and simultaneously higher efficiency.

Alternatively, the compressor drive can be carried out by means of a gear transmission. A driven transmission gear is screwed or shrunk onto one of the four rotors, which gear engages the driving gear of the drive shaft.

To construct the drive of the rotary screw compressor in a manner which will improve the sealing of the compressor, a clutch according to one of the known magnetic principle is used for the rotary compressor drive, wherein the external magnets of the second (on the side of the motor) clutch half carry with them the internal magnets of the first (on the side of the compressor) clutch half.

The first magnetic clutch half, on the side of the compressor, is provided on the end of the drive shaft of the rotary screw compressor. Between the first clutch half and the second clutch half a bellows is provided, which seals the compressor in an airtight manner. The second clutch half of the magnetic clutch is on the side of the motor.

This magnetic clutch is not an electro-magnet clutch, but a permanent-magnet clutch. Such clutches, which serve the purpose of transferring the torque, are basically known. There are permanent-magnet clutches which transfer torques of 312 Nm, for example. This torque is adequate in almost all cases when used as a driving clutch for rotary screw compressors.

The use of such a magnetic clutch in the present case makes the use of a bellows instead of a common shaft seal feasible, due to which the compressor can be closed air-tight and leakages can be eliminated completely.

BRIEF DESCRIPTION OF THE DRAWINGS

Embodiments of the invention are explained below in detail based on the schematic drawings.

The following is shown.

DESCRIPTION OF THE PREFERRED EMBODIMENTS

Figure 1:
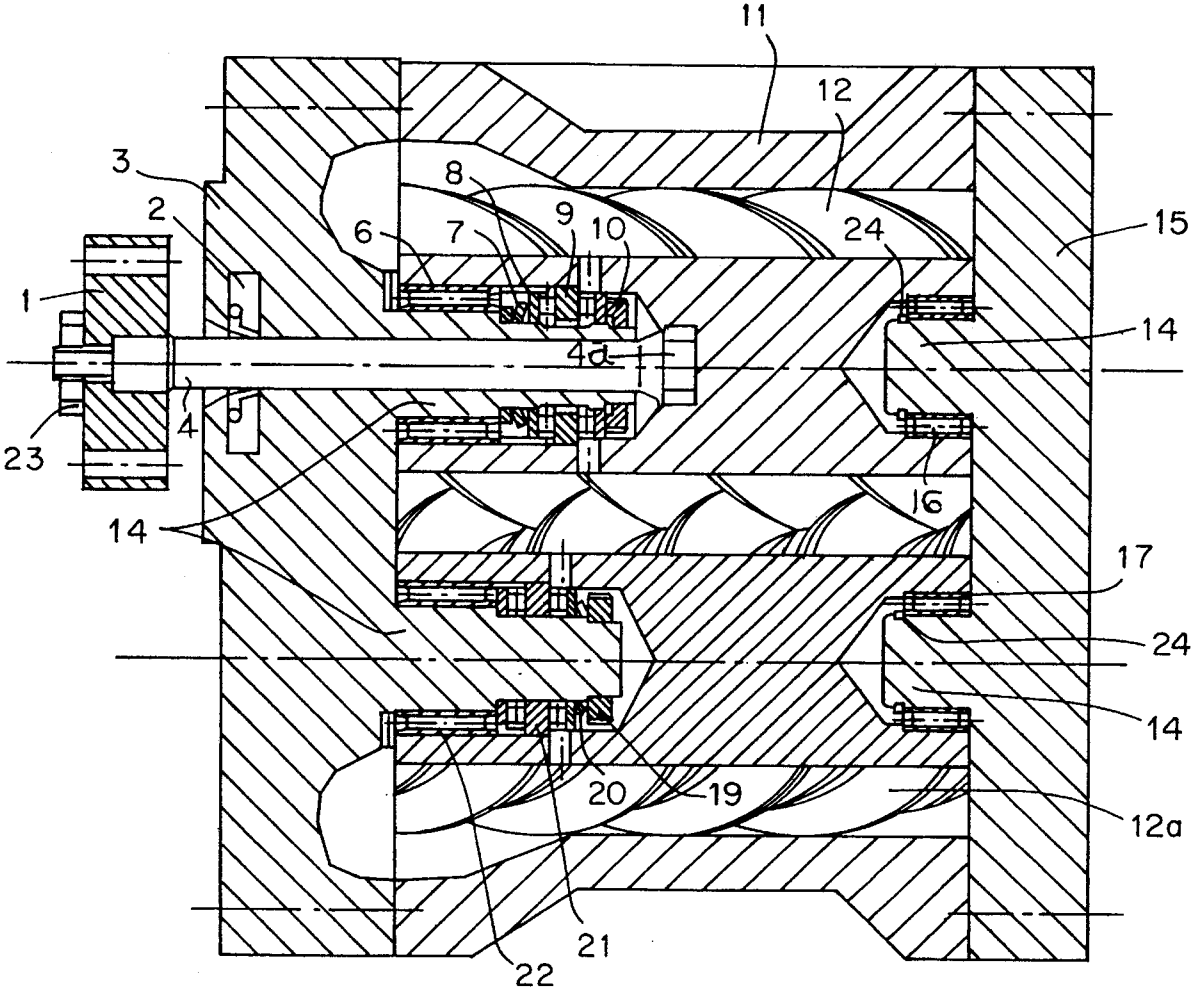
FIG. 1—a longitudinal section through a rotary screw compressor with a torsion shaft, FIG. 2—a longitudinally sectioned gear drive, in detail, FIG. 3—a longitudinal section through a rotary screw compressor with torsion shaft and sealing discs, FIG. 4—a cut-away of the drive of a rotary screw compressor with internally mounted rotors.

The bearing housing (3) illustrated in FIG. 1 of the driven side has on its inside a spigot (14) to engage the bore of the rotor (12) and a further spigot (14) to engage the rotor (12*a*).

The bearing housing (15) on the pressure side has also spigots (14) on its inside. One of these spigots engages the bore of the rotor (12) and the other the bore of the rotor (12*a*).

Accordingly, the rotors (12, 12*a*) according to the invention inside of the compressor housing (11) include only the helically geared male rotor and the helically geared female rotor, in the ends of which central bores are provided to accommodate the spigots (14).

In the embodiment according to FIG. 1 the drive of the compressor is on the rotor's (12) suction side.

The mounting of the rotors (12, 12*a*) on the spigots on the pressure side is carried out by radial bearings (16, 17). On the suction side the rotors (12, 12*a*) are mounted on the spigots (14) in radial bearings (6, 22) and in axial bearings (9, 21).

The driving of a rotor (12) is carried out on the suction side with the aid of a torsion shaft (4). This torsion shaft is guided through a bore in the bearing housing (3) on the driving side and in the spigot (14) and has at the inside end a swelling (4*a*), which is situated in a recess of the bore. The thickened end (4*a*) of the torsion shaft (4) can be inserted into the recess of the bore during the assembly of the compressor. Subsequently the bearing housing (3) on the drive side is slipped over the torsion shaft (4) and the spigot (14) with the bearings (6, 9) pushed into the rotor (12).

Due to this a form-locking connection is established between the torsion shaft (4) and the rotor (12). Inside of the bearing housing (3) on the drive side a shaft seal (2) is provided for the torsion shaft (4).

On the other end of the torsion shaft (4) the clutch half (1) belonging to the compressor is placed, which is held by a nut (23).

Figure 2:
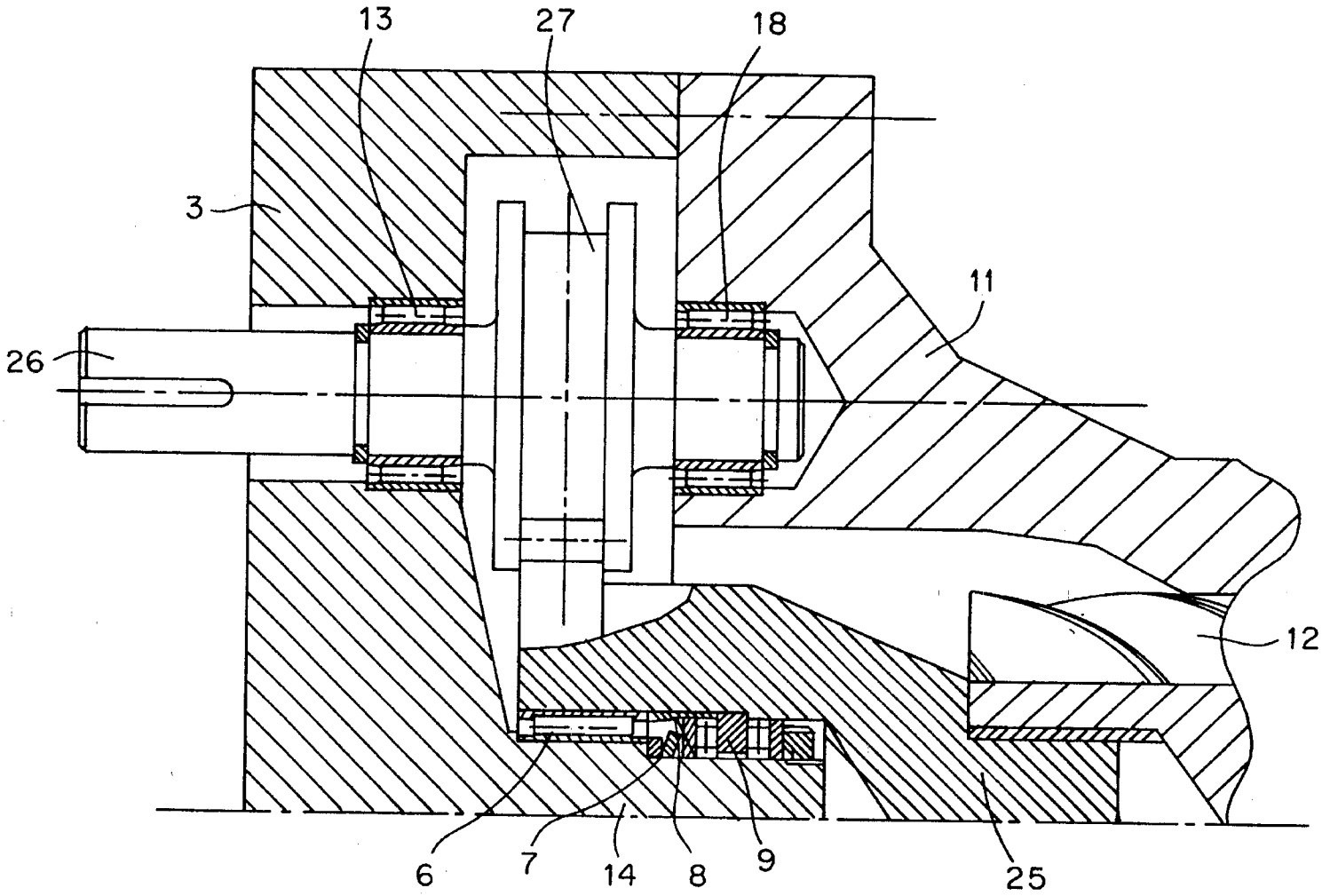

FIG. 2 shows an alternative drive wherein the rotor (12) is driven by a gear drive on the suction side. A driven gear (25) can be recognised on the rotor's (12) side, which gear engages a driving gear (27) with the drive shaft (26). The drive shaft is mounted in radial bearings (13, 18) on the inside of the drive unit of the compressor housing (11) and on the outside of the drive unit of the bearing housing (3) on the drive side.

In FIG. 2, in the bottom centre, the mounting of the spigot (14) in the bore of the driven gear (25) can be recognised, namely the radial bearing (6) and the axial bearing (9). Furthermore a pre-tensioning spring (7) and a spacer (8) are illustrated.

Figure 3:
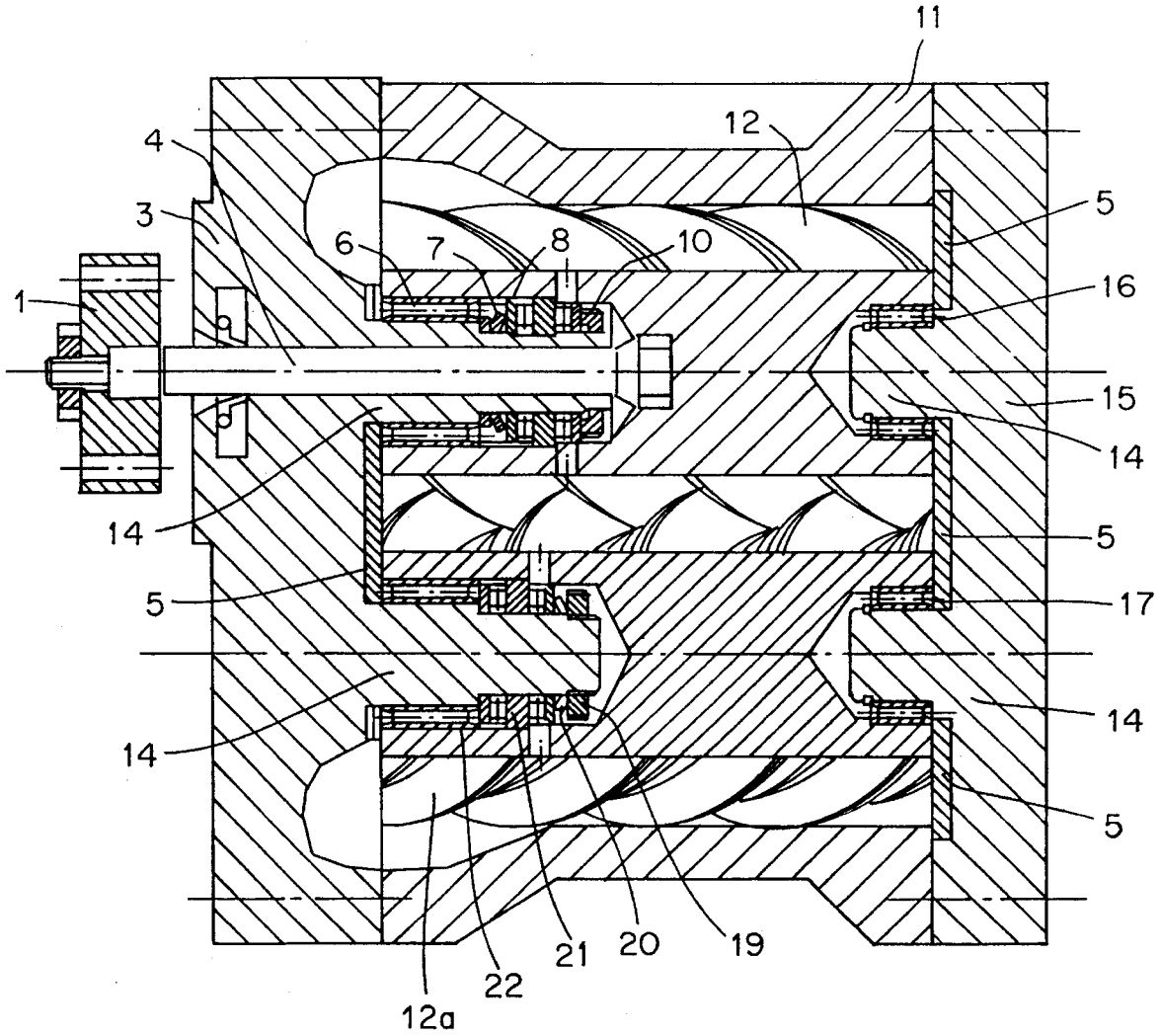

An embodiment of the sealing according to the invention is explained below in detail based on FIG. 3.

The bearing housing (3) on the drive side has on its inside a spigot (14) to engage the bore in the rotor (12) and a further spigot (14) to engage the rotor (12*a*).

The bearing housing (15) on the pressure side also has spigots (14) on its inside. One of these spigots (14) engages the bore in the rotor (12) and the other the bore in the rotor (12*a*).

The mounting of the rotor (12) on the drive side is designated by (6, 7, 8, 9, 10), that of the rotor (12*a*) by (19, 20, 21, 22).

The mounting on the pressure side on the spigots (14) of the bearing housing (15) is carried out by radial bearings (16, 17). The compressor drive is situated on the suction side on the rotor (12). This rotor is driven by a torsion shaft (4). At one end of the torsion shaft (4) the clutch half (1) on the compressor's side can be recognised.

Between the end faces of the rotors (12, 12*a*) which are provided in the compressor housing (11) and the housing parts (3, 15) on the suction and pressure sides sealing discs (5) are situated, which are screwed, glued or form-locked into recesses in these parts (3, 15) of the housing. These sealing discs are made of a sintered PTFE-mica mixture or of a material having similar properties.

Figure 4:
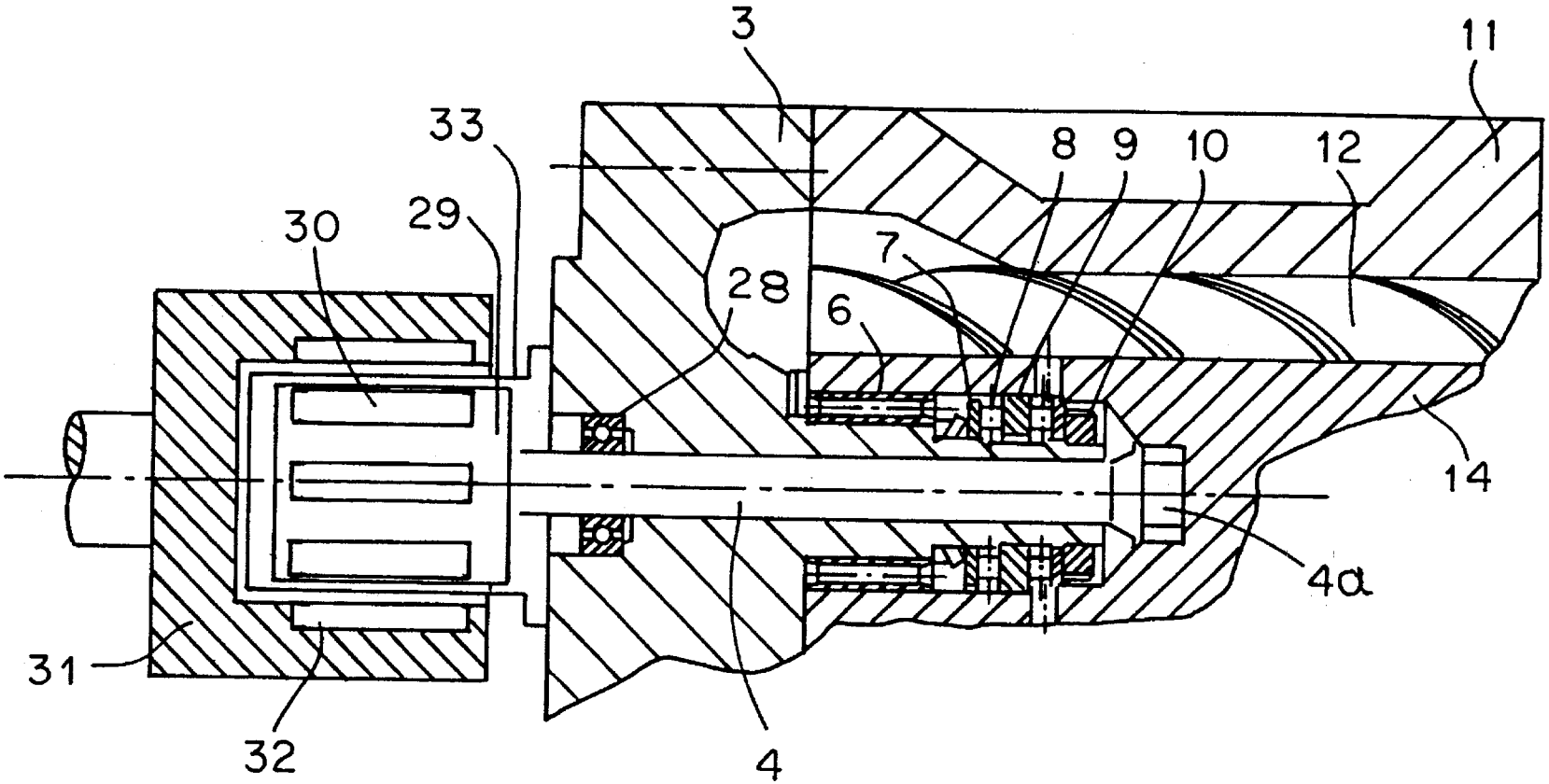

FIG. 4 shows a rotor (12) provided on the drive side in the compressor housing (11). A spigot (14) on the bearing housing (3) engages the rotor (12). Here too radial (6) and axial (9) bearings are used for the mounting of the rotor.

A torsion shaft (4) is guided through a bore in the bearing housing (3) and in the spigot (14), which torsion shaft is mounted in the bearing housing (3) by means of a support bearing (28). The inner end of the torsion shaft (4*a*) is connected with the rotor (12) in a form-locking manner.

On the torsion shaft (4) the half clutch (29) of the magnetic clutch on the compressor side is provided, which clutch has internal magnets (30). The clutch half (31) of the magnetic clutch on the drive side surrounds the aforementioned clutch half. It contains the external magnets (32).

Between the clutch half (29) on the compressor side and the clutch half (31) on the motor side a bellows (33) is provided. This can be manufactured from a metallic material.

I claim:

1. A rotary compressor with enmeshment between a helically geared male rotor and a helically geared female rotor, comprising: a suction side and a pressure side on the compressor; bearing housings on the suction side and the pressure side and having four spigots protruding into bores inside said rotors; said rotors having radial and axial bearings; a torsion shaft with a half clutch for driving the compressor and being guided through a bore in one of said bearing housings and in one of said four spigots; a shaft seal on a side of said bearing housings and at an end of said bore guiding said torsion shaft and having a recess for producing a form-locking connection between a head of the torsion shaft and the rotors.

2. A rotary compressor as defined in claim 1, wherein said bores in said rotors for said spigots have axial and radial bearings on the suction side and radial bearing on the pressure side.

3. A rotary compressor as defined in claim 2, wherein said bores in said rotors for said spigots have radial bearings on the suction side and axial and radial bearings on the pressure side.

4. A rotary compressor as defined in claim 1, including sealing discs between end faces of said rotors on said housings on a drive side and said pressure side; said sealing discs being fastened to said housings and being comprised of substantially a sintered PTFE-mica mixture.

5. A rotary compressor as defined in claim 4, wherein said sealing disks are screwed onto said housings.

6. A rotary compressor as defined in claim 4, wherein said sealing disks are glued on said housings.

7. A rotary compressor as defined in claim 4, wherein said sealing disks are inserted form-locking in said housings.

8. A rotary compressor as defined in claim 1, wherein said rotors have four ends; a driven gear fastened to one of said four ends of the rotors; a driving gear engaging said driven gear, said driving gear having a drive shaft mounted in radial bearings of the compressor and said bearing housings.

9. A rotary compressor as defined in claim 8, wherein said driven gear is screwed onto one of said four ends of said rotors.

10. A rotary compressor as defined in claim 8, wherein said driven gear is shrunk onto one of said four ends of said rotors.

11. A rotary compressor as defined in claim 1, including a magnetic clutch with a first clutch half and a second clutch half; a drive shaft of a driven rotor being connected to said first clutch half, said first clutch half having a circumference and having internal magnets distributed equispaced on said circumference, said second clutch half surrounding said first clutch half and having external magnets; and a bellows between said first clutch half and said second clutch half.

12. A rotary compressor as defined in claim 1, including a drive shaft connected to said magnetic clutch and being a torsion shaft, said torsion shaft being guided through a bore in said bearing housings and in said spigots inside of a driven one of said rotors and being mounted in a support bearing of the bearing housings.

* * * * *